US007849845B2

(12) United States Patent
Page et al.

(10) Patent No.: US 7,849,845 B2
(45) Date of Patent: Dec. 14, 2010

(54) DEGASSING TOOL FOR HIGH PRESSURE PRE-CHARGED PNEUMATIC AIRGUN

(75) Inventors: Russell D. Page, Palmyra, NY (US); David C. Snyder, Palmyra, NY (US)

(73) Assignee: Crosman Corporation, East Bloomfield, NY (US)

( * ) Notice: Subject to any disclaimer, the term of this patent is extended or adjusted under 35 U.S.C. 154(b) by 583 days.

(21) Appl. No.: 11/968,460

(22) Filed: Jan. 2, 2008

(65) Prior Publication Data

US 2010/0282324 A1 Nov. 11, 2010

(51) Int. Cl.
*F41B 11/00* (2006.01)

(52) U.S. Cl. ..... 124/76; 124/73

(58) Field of Classification Search ..... 124/71–77
See application file for complete search history.

(56) References Cited

U.S. PATENT DOCUMENTS 4,137,893 A * 2/1979 Beauchamp ..... 124/72
5,460,154 A * 10/1995 Mattern et al. ..... 124/56
6,925,997 B2 8/2005 Sheng

FOREIGN PATENT DOCUMENTS

JP 2003-302195 A 10/2003

OTHER PUBLICATIONS

Patent Cooperation Treaty International Search Report and Written Opinion; dated Mar. 26, 2009, 7 pages.

* cited by examiner

*Primary Examiner*—Troy Chambers
(74) *Attorney, Agent, or Firm*—Brian B. Shaw, Esq.; Michael J. Didas, Esq.; Harter Secret & Emery LLP

(57) ABSTRACT

A pre-charged pneumatic airgun includes a reservoir, a stopper, a barrel and a manually actuated degassing tool. The reservoir contains a volume of compressed fluid and includes a discharge port disposed therein through which the compressed fluid is selectively discharged from the reservoir. The stopper is disposed in the discharge port and is moveable between a normal position sealing the discharge port in an actuated position allowing passage of the compressed air through the discharge port. The stopper is biased to the normal position by a biasing force. The barrel is in fluid communication with the discharge port. When the stopper is disposed in the discharged position, the compressed fluid discharged through the discharge port is further exhausted through the barrel. The manually actuated degassing tool is disposed in the air gun for manually overcoming the biasing force to move the stopper from a normal position to the actuated position, and for maintaining the stopper in the actuated position to degas the reservoir.

21 Claims, 5 Drawing Sheets

DEGASSING TOOL FOR HIGH PRESSURE PRE-CHARGED PNEUMATIC AIRGUN

BACKGROUND OF THE INVENTION

1. Technical Field

The present invention relates to pre-charged pneumatic airguns. More specifically, the present invention relates to a degassing tool for exhausting a pressurized fluid from a reservoir contained on a pre-charged pneumatic airgun and used to fire the pre-charged pneumatic airgun.

2. Description of Related Art

Pre-charged pneumatic airguns are generally known in the art. Such guns utilize a compressed fluid, often compressed air, to propel pellets from a gun. One type of pre-charged pneumatic airgun that is known utilizes a reservoir of the compressed fluid that is in some way fixed to the gun to provide a steady supply of compressed fluid. Over time, and especially with repeated use, the fluid contained within the reservoir will begin to dissipate, until the gun ceases to function properly. The reservoir must then be replaced or preferably recharged.

Several variations of pre-charged pneumatic airguns exist, and they operate with many different sorts of compressed fluids. For example, compressed gases such as $CO_2$, nitrogen, and high pressure air are known, as are liquid propellants, and assorted mixtures. However, many of today's guns are designed to be operable using more than one of these compressed fluids, for example, depending upon the desired firing characteristics. It may be desirable to alternate between fluids, for example, from use to use of the pre-charged pneumatic airgun. In such cases, it is desirable, and often times vital, that any compressed fluid contained in the reservoir be expelled from the reservoir before filling the reservoir with a new compressed fluid. If the reservoir is to be removed and replaced with a new reservoir, it is likewise desirable that all of the compressed fluid be exhausted from the reservoir prior to removing the reservoir.

Conventionally, expelling the compressed fluid from the reservoir involves repeatedly firing the gun without ammunition to expel all the pressurized fluid in the reservoir. However, this can be time consuming and can cause undue stress to the components of the gun.

Accordingly, there is a need in the art for an improved method for exhausting a compressed fluid from a reservoir of a pre-charged pneumatic airgun. There also is a need in the art for a degassing tool capable of quickly and effectively exhausting the contents of the reservoir without additional strain and stress on the components comprising the gun.

SUMMARY OF THE INVENTION

The present invention addresses the foregoing needs in the art by providing a degassing tool and an improved pre-charged pneumatic airgun including a degassing tool.

In one aspect of the invention, a pre-charged pneumatic airgun includes a reservoir containing a volume of compressed fluid, a discharge port disposed in the reservoir, a stopper disposed in the discharge port, a barrel in fluid communication with the discharge port, and a manually actuated degassing tool. The discharge port is disposed in the reservoir through which the compressed fluid is selectively discharged from the reservoir. The stopper is disposed in the discharge port and is moveable between normal positions sealing the discharge port and an actuated position allowing passage of the compressed air through the discharge port. The stopper is biased to the normal position by a biasing force. The barrel is in fluid communication with the discharge port such that when the stopper is disposed in the discharge position, the compressed fluid discharged through the discharge port is further exhausted through the barrel. The manually actuated degassing tool is disposed in the air gun for manually overcoming the biasing force to move the stopper from the normal position to the actuated position, and for maintaining the stopper in the second position to degas the reservoir.

In another aspect, the invention includes a degassing tool for a pre-charged pneumatic airgun having a reservoir containing a fluid disposed therein, the fluid being exhausted through a discharge port that is normally occluded by a stopper when the stopper is moved from a normally closed position to a discharge position. The degassing tool includes an elongate shaft, a thread, and a head. The shaft has a first end and a second end insertable into a threaded aperture formed in a housing of the pre-charged pneumatic airgun such that the second end contacts a surface in the housing and the first end is disposed outside the housing. The thread is formed on at least a portion of the elongate shaft to cooperate with the threaded aperture. The head is formed on the first end of the elongate shaft for manipulation by a user to promote threading the elongate shaft in the aperture. Manipulation of the head by the user to move the degassing tool further into the housing causes the degassing tool to move the surface contacted by the second end of the elongate shaft to move the stopper to the discharge position.

These and other aspects and features of the present invention may be understood with reference to the following description and attached figures in which preferred embodiments of the present invention are described and illustrated.

BRIEF DESCRIPTION OF THE DRAWING FIGURES

DETAILED DESCRIPTION OF THE INVENTION

Preferred embodiments of the invention now will be described with reference to the figures.

As noted above, the invention generally relates to pre-charged pneumatic airguns in which a pressurized fluid contained in a reservoir is exhausted to expel ammunition from the gun. As is generally known in the art, the fluid is generally in gaseous form when expelled from the container. However, the fluid may be stored in the container in virtually any state. Accordingly, as used herein, the term "fluid" shall be understood to encompass gasses, liquids, and any mixture thereof.

Figure 1:
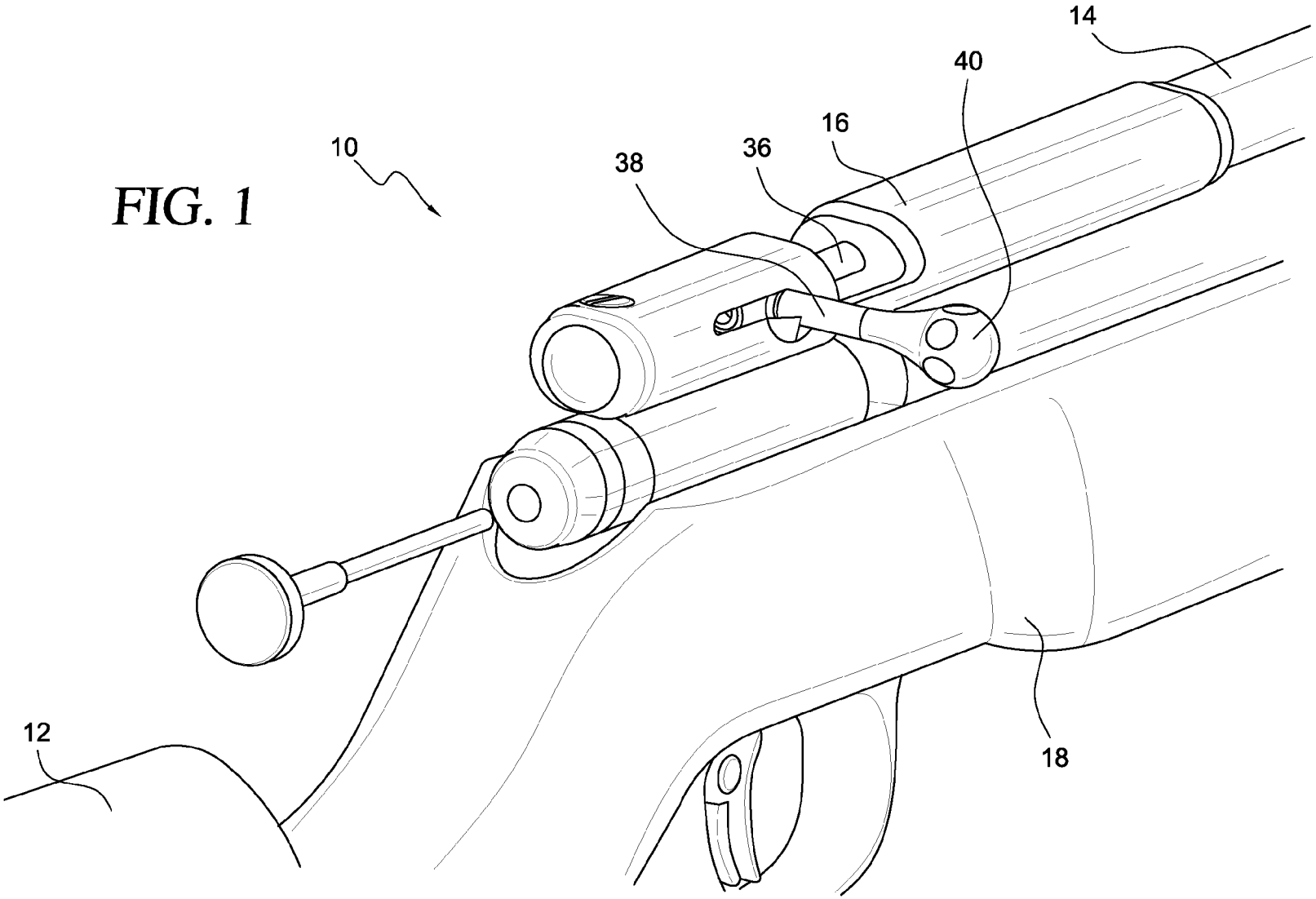
FIG. 1 is a perspective view of a pre-charged pneumatic airgun according to an embodiment of the present invention.
Figure 2:
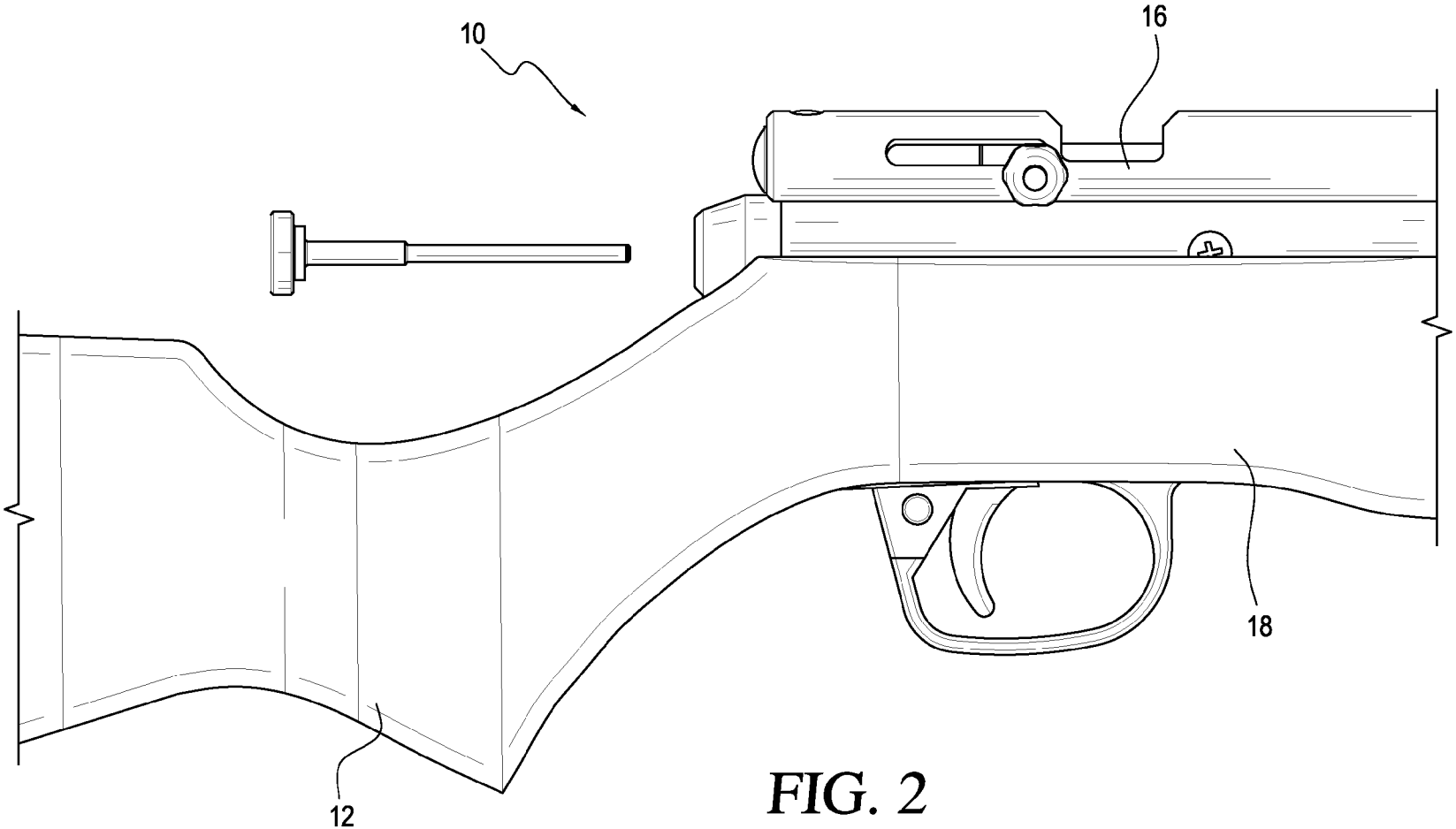
FIG. 2 is a side view of the pre-charged pneumatic airgun of FIG. 1.

As noted above, and as illustrated in FIGS. 1 and 2, the present invention generally relates to pre-charged pneumatic airguns. As illustrated in FIG. 1, a pre-charged pneumatic airgun 10 generally includes a stock 12, a barrel 14, a breech 16, and a housing 18. The embodiment illustrated is of a bolt action type of gun, although such is not required. As will be appreciated from the following discussion, the present invention may be used with any number of types of pre-charged pneumatic airguns. The housing 18 generally shields the user from exposure to the inner workings of the pre-charged pneumatic airgun 10.

Figure 3:
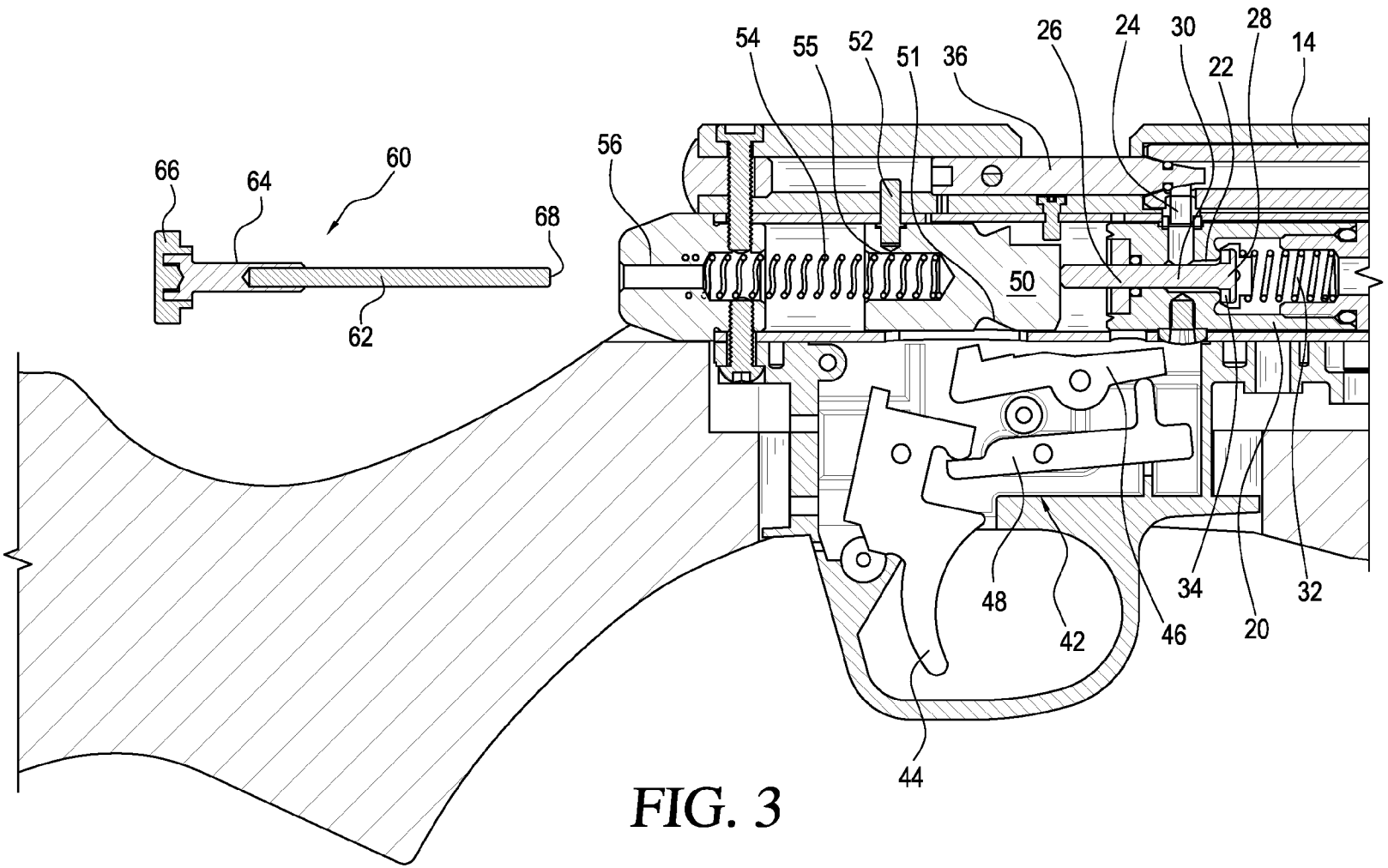
FIG. 3 is a cross-sectional side view of the pre-charged pneumatic airgun of FIG. 1.

FIG. 3 is a view of the pre-charged pneumatic airgun 10 according to the present invention with the housing 18 removed. As illustrated therein, the pre-charged pneumatic airgun 10 generally includes a reservoir 20 containing a compressed fluid. The fluid may be compressed air, $CO_2$, or any other functional gas, liquid, or mixture useable in pre-charged pneumatic airguns.

The reservoir 20 generally includes a discharge port 22 through which the compressed fluid within the reservoir 20 may be discharged. Preferably, compressed fluid discharged through the discharge port 22 enters a duct 24 that fluidly connects the reservoir to the barrel 14 of the gun. As illustrated, the reservoir is generally cylindrical having an axis that is substantially parallel with an axis of the barrel 14 of the gun 10. Similarly, the discharge port 22 is arranged substantially parallel to the barrel, extending from an end of the reservoir 20. The duct 24 preferably is transverse to the axis of the cylinder and discharge port, connecting the substantially parallel barrel and discharge port. In other embodiments, the discharge port may be substantially L shaped, having an opening in the end of the cylindrical reservoir and a second opening perpendicular thereto, exhausting into the barrel 14.

The pre-charged pneumatic airgun 10 preferably also includes a stopper 26 disposed in the discharge port for sealing the discharge port 22. As illustrated, the stopper 26 generally includes a head 28 and a shaft 30 and is thus shaped generally as a piston. Preferably, the head 28 of the stopper 26 is disposed within the reservoir 20 with the shaft 30 of the stopper 26 extending through the discharge port and extending completely out of the reservoir 20. A stopper spring 32 preferably also is disposed within the reservoir 20 biasing the stopper 26 into a position sealing the discharge port 22. A seal 34 preferably is included on the side of the head 28 proximate the shaft 30 of the stopper 26 for contacting an inner wall of the reservoir to effectively seal the discharge port. As will be understood, by overcoming the bias force of the stopper spring 32, compressed fluid is allowed to escape past the head 28 of the stopper 26 and thereby discharge from the reservoir 20 through the discharge port 22 into the duct 24 out of the gun 10 through the barrel 14.

As noted above, the present invention is embodied in a bolt action style rifle. Accordingly, the preferred embodiment also includes a bolt 36 disposed near a rearward side of the barrel 14. As is conventionally known, the bolt preferably includes a bolt arm 38 and a bolt grip 40, which are best illustrated in FIG. 1. As is generally understood in the art, by gripping the bolt grip 40 and actuating the bolt 36 in a rearward direction i.e., in a direction towards the stock 12 of the gun 10, the breech 16 is exposed for insertion of a projectile into the pre-charged pneumatic airgun 10 for expulsion through the barrel 14.

The pre-charged pneumatic airgun 10 preferably also includes a trigger grouping 42 which is actuated by a user to fire a projectile from the gun. Generally, the trigger grouping 42 includes a trigger 44, a sear 46, a lever 48, a hammer 50, a hammer pin 52, and a hammer spring 54. As is generally well known in the art, when a user actuates the bolt 36 in a rearward direction, the bolt contacts the hammer pin 52, which is fixed to the hammer 50. Continued movement of the bolt in the rearward direction moves the hammer 50 in a rearward direction against the force of the hammer spring 54. The sear 46 preferably is biased against a surface of the hammer, that surface having a notch for receiving the sear when the hammer is moved sufficiently rearwardly. With the sear engaging the notch 51 of the hammer 50, the hammer is retained in its rearward, cocked position. The bolt 36 is than free to be moved forward again to close the breech 16. In the cocked position, the trigger 44 may be actuated by a user, preferably, by pulling the trigger 44 and causing it to rotate about a pivot point. This movement of the trigger is transferred to the sear via the lever 48 to cause the sear 46 to disengage from the notch 51 formed in the hammer 50. The hammer spring 54 thus forces the hammer forward into contact with the stopper 26. The hammer 50 contacts the stopper with sufficient force to overcome the biasing force of the stopper spring 32 to temporarily unseat the seal 34 of the stopper 26 from the inner surface of the reservoir 20 and thus allow an amount of compressed fluid to escape from the reservoir. This burst or puff of compressed fluid exits the reservoir through the discharge port, is communicated through the duct 24, and exhausts through the barrel 14. The fluid is sufficiently compressed that it forces any projectile in the barrel from the barrel, thereby shooting the gun.

As will be generally understood, the hammer must strike the stopper with sufficient force to overcome both the biasing force of the stopper spring 32 as well as the force imparted on the head 28 of the stopper 26 by the pressurized fluid contained in the reservoir 20. In most applications, it is preferable that the compressed fluid be at a pressure from about 2000 psi to about 3000 psi. However, the force of the spring and the reservoir are substantial such that the contact of the hammer 50 on the shaft 30 of the stopper 26 will only temporarily or momentarily unseat the seal 34 of the stopper 26 from the inner surface of the reservoir 20. Accordingly, only a short burst of air is dispensed through the barrel, which is preferred for firing the gun. After striking the stopper 26, the gun returns to an equilibrium position in which the discharged port is occluded by the stopper 26 due to the internal pressure of the reservoir and the biasing force of the stopper spring 32.

The gun just described, like other conventional guns of its type, is designed for multiple firings, i.e., until the pressure within the reservoir becomes insufficient to satisfactorily discharge projectiles from the barrel 14. This may be anywhere from on the order of about 30 projectiles to over 300 projectiles, depending on the size of the reservoir, the pressure maintained within the reservoir, and other factors. However, it is often desirable to bleed or otherwise remove the compressed fluid from the reservoir, for example, for storage or to change the compressed fluid within the reservoir. For example, a user may have a reservoir that is filled with compressed air, but would like to replace the compressed air with $CO_2$. Similarly, it may be desirable to bleed off excess pressure for shipping or when the gun is otherwise not in use.

As described above, one method for removing all of the fluid from the reservoir would be to continuously re-cock and fire the gun until all of the compressed fluid is removed from the reservoir. However, this method would be time consuming and the excessive firing creates undo wear on the gun. Accordingly, the present invention provides a degassing tool that allows a user to manually and safely bleed off the fluid contained within the reservoir.

As shown in FIG. 3, the stopper 26, the hammer 50 and the hammer spring 54 generally align along a single axis along which they are moveable. Along this same axis, an aperture 56 is formed through the back of the gun 10. Preferably, the aperture 56 is threaded. The degassing tool 60 generally includes a shaft 62, a threaded neck 64 and a head 66. The shaft 62 of the degassing tool is received within the aperture 56, and the threaded neck cooperates with the threaded aperture 56.

Figure 4:
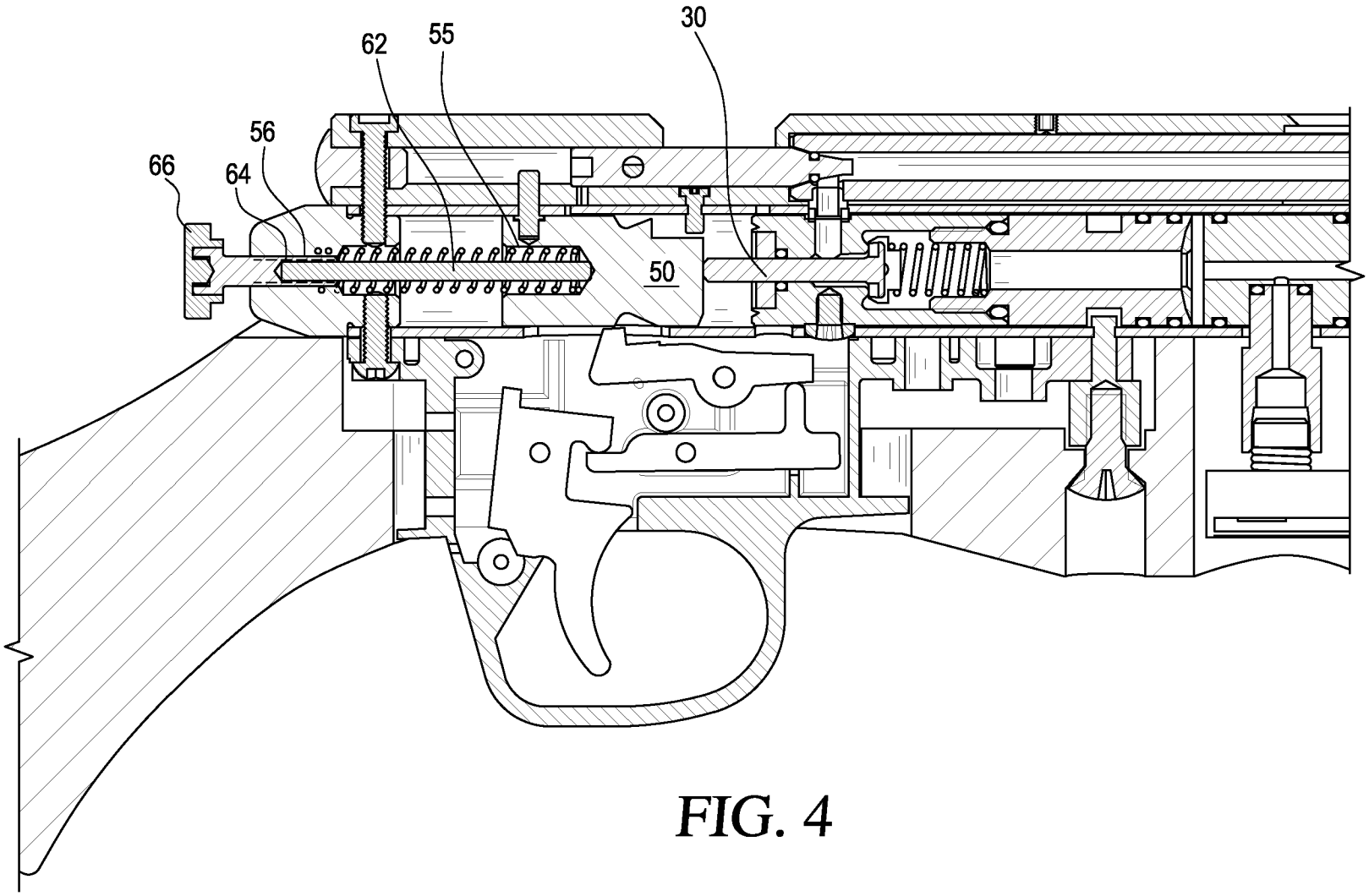
FIG. 4 is a cross-sectional diagram similar to that of FIG. 3, with a degassing tool according to a preferred embodiment of the invention inserted into the pre-charged pneumatic airgun.

In operation, as generally shown in FIG. 4, a user inserts the degassing tool 60 into the aperture 56, and engages the threaded neck 64 with the threads formed in the aperture 56. As the degassing tool 60 is further threaded into the aperture, a distal end 68 of the shaft 62, i.e., the end opposite the head 66, contacts the hammer 50 to bias the hammer against the adjacent end of the stopper 26. Continued insertion of the degassing tool 60 into the aperture 56, i.e., by continued rotation of the head 66, causes the hammer to press against the stopper 26 to eventually overcome the biasing force seating the seal 34 against the inner wall of the reservoir. Accordingly, a user can manually actuate the stopper 26 to expel all of the contents of the bleed valve.

In a preferred embodiment of the invention, the threaded neck 64 of the degassing tool sufficiently engages with the threaded aperture before the distal end contacts the hammer, such that the substantial pressure within the reservoir does not force the degassing tool to back out of the aperture. Generally from about three to about five threads should be engaged before the hammer is engaged by the degassing tool. Also, it is preferable that fine threads be used, although such is not required.

In the preferred embodiment, as shown, shaft 62 of the degassing tool 60 is disposed inside the coils forming the hammer spring 54 and the distal end 68 contacts the hammer 50 in a bore 55 formed in a rearward end, i.e., an end closer to the stock 12 of the gun 10, of the hammer 50. An end of the hammer spring 54 also is preferably disposed in the bore 55, to constrain movement of the hammer spring other than compression and extension of the spring along the axis of the spring.

In addition to contacting the rearward side of the hammer and biasing the hammer in a forward direction, the degassing tool also acts as a stop to impede relative rearward movement of the hammer. This is advantageous because it inhibits a user from actuating the bolt 36 and thereby accessing the breech during exhausting of the reservoir. As should be appreciated, if the breech is open when the pressurized air is exhausted, the air could exhaust through the open breech instead of through the barrel, as is intended.

The present invention also provides a safety feature in that the degassing tool will only function after firing, i.e., when the barrel is free of ammunition. Specifically, when the gun is cocked, the sear prohibits forward motion of the hammer, even when a force is applied to the hammer using the degassing tool. Care should generally be taken to select appropriate materials for the hammer and the sear (and other components) such that the hammer and/or the sear will not fail if the user attempts to bias the hammer with the degassing tool with the hammer in the cocked position. According to this safety feature, only after pulling the trigger, and thus firing any ammunition contained in the barrel will the sear be removed from the path of travel of the hammer, such that the hammer can be moved forward using the degassing tool to exhaust the compressed fluid stored in the reservoir.

The degassing tool also may be provided with an alternative safety feature. In particular, the shaft 62 preferably is of sufficient length that if the degassing tool is inserted through the aperture with the hammer in the cocked position, the distal end 68 of the degassing tool 60 will contact the hammer 50 before the threaded neck 64 will engage with the threads formed in the aperture 56. Accordingly, a user will be unable to threadably engage the degassing tool 60 in the aperture 56 when the hammer is in the cocked position. Only upon pulling the trigger to fire the pre-charged pneumatic airgun 10 will a user be able to insert the degassing toll sufficiently far into the aperture to engage the threaded neck 64 with the threaded aperture 56.

The degassing tool may be designed to be permanently retained in the gun, or it may be completely removable. If the tool is to be retained in the gun, it must be capable of being actuated sufficiently rearward so as not to impede normal use, i.e., cocking and firing, of the gun. Maintaining the degassing tool in the gun may be preferred, because it prevents unwanted residue from entering the housing through the exposed aperture and because it alleviates the need to carry and account for the degassing tool. However, the length of the stroke necessary to ensure that the degassing tool does not impede normal movement of the hammer may make it impractical to leave the degassing tool in the gun at all times, for example, because the tool would extend too far from the back of the gun to be desirable. In applications in which the degassing tool is to be removed, a plug may be provided to fill the aperture. Moreover, a separate threaded aperture (not shown) may be provided elsewhere on the gun 10 to provide a receptacle in which the degassing tool can be stored when not in use.

Modifications of the invention also are contemplated. For example, it is envisioned that other degassing tools may be used that actuate the stopper into the discharge position, by acting directly or indirectly on the stopper to overcome the force of the pressurized fluid in the reservoir and the stopper spring on the stopper. For example, a transverse opening may be formed through the housing of the gun proximate the hammer or some other surface. The opening receives a key having a cammed or stepped end that is insertable into the opening to contact the hammer or the other surface. By rotating the key of this embodiment, the hammer is actuated forward to actuate the stopper into the discharge position. Preferably, the key has a flat surface that contacts a flat surface of the hammer when the key is turned to exhaust the reservoir, with the flat surface maintaining the hammer, and therefore the stopper, in the actuated position.

In another contemplated embodiment of the invention, instead of actuating the shaft of the degassing tool by threading, a lever or the like could be provided to actuate the shaft. The lever could be disposed on the back of the gun or could be formed on a side of the gun, and preferably would include a cammed surface that allows movement of the degassing tool that is translated to movement of the stopper to the discharge position.

Figure 5:
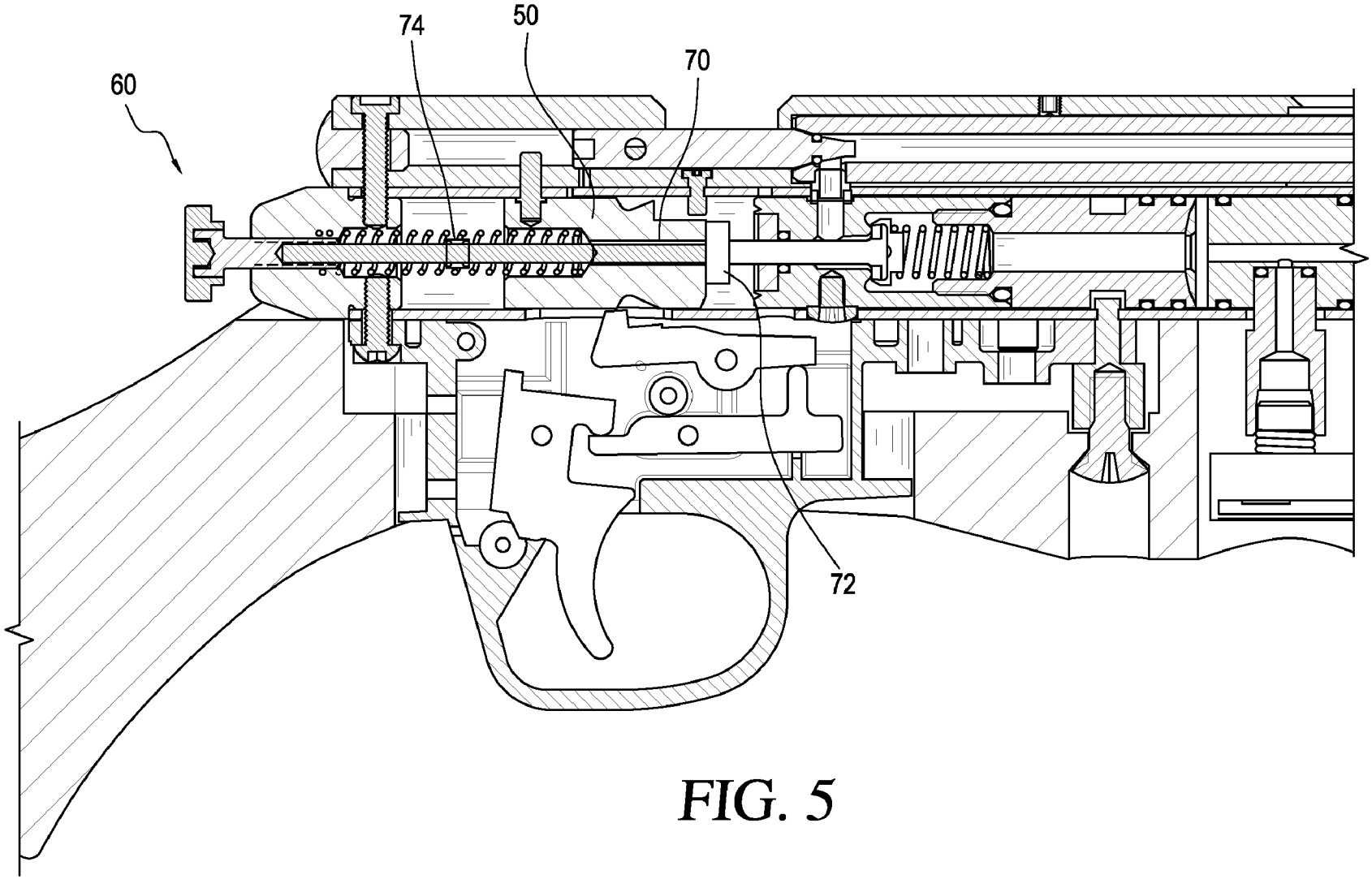
FIG. 5 is a cross-sectional side view of another embodiment of a pre-charged pneumatic airgun with a degassing tool according to the present invention.

Yet another embodiment of the invention is illustrated in FIG. 5. This embodiment is similar to the embodiment of FIGS. 3 and 4, except that the hammer has a hole 76 formed axially therethrough. Specifically, the hole 70 is preferably formed coaxially with the axis of the stopper 26. In this embodiment, the elongate shaft 62 of the degassing tool 60, when inserted into the aperture 56 formed in the back of gun 10, will pass through the hammer 50, such that the distal end of the elongate shaft will contact the stopper 26 directly. The hammer 50 and the degassing tool 60 are movable with respect to each other, namely, the elongate shaft of the degassing tool slides inside the hole 70 formed axially through the hammer 50.

In this embodiment, the degassing tool 60 can preferably be left in the gun 10 at all times, including during normal operation of the gun. Specifically, the degassing tool 60 need not be withdrawn or backed out as far in this embodiment to allow for firing of the gun 10, because the degassing tool is not in the path of travel of the hammer. Instead, the degassing tool need be retracted only sufficiently to not contact the stopper when the stopper is in the normal or sealing position.

In the embodiment of FIG. 5, the distal end of the elongate shaft (and likely a portion of the elongate shaft that passes through the hammer) are of sufficiently small diameter that a portion of the hammer disposed around the periphery of the distal end can also contact the stopper, i.e., to allow for normal firing operation. Put another way, the end of the shaft of the stopper is of a sufficient diameter that the degassing tool contacts an inner portion of the end and the hammer contacts an outer portion of the end, such that both degassing and firing can be accomplished, as desired. A larger surface may be provided at the end of the shaft of the stopper by either increasing the overall diameter of the shaft of the stopper, or by forming a flange 72 or the like on the end of the shaft of the stopper.

As just described, in the example of FIG. 5, the hammer 50 moves relative to the degassing tool 60, which more easily allows the degassing tool to be kept in the gun at all times. Because the degassing tool 60 acts directly on the stopper, however, there is no safety feature that keeps a user from degassing the gun when the hammer is in the cocked position. Thus, a user could degas the gun when it is loaded. Accordingly, a stop or a shoulder 74 may be provided along the length of the elongate shaft comprising the degassing tool, which is located to contact the hammer 50, e.g., the bottom of the bore 55 of the hammer 50, when the hammer is in the cocked position, before the distal end contacts the stopper. In this manner, actuation of the degassing tool to degas the reservoir is prevented when the hammer is cocked.

The foregoing embodiments of the invention are representative embodiments, and are provided for illustrative purposes. The embodiments are not intended to limit the scope of the invention. Variations and modifications are apparent from a reading of the preceding description and are included within the scope of the invention. The invention is intended to be limited only by the scope of the accompanying claims.

The invention claimed is:

1. A pre-charged pneumatic airgun, comprising:

a reservoir containing a volume of a compressed fluid, the reservoir having a discharge port disposed therein through which the compressed fluid is selectively discharged from the reservoir;

a stopper disposed in the discharge port and movable between a normal position sealing the discharge port and an actuated position allowing passage of the compressed air through the discharge port, the stopper being biased to the normal position by a biasing force;

a barrel in fluid communication with the discharge port, wherein when the stopper is disposed in the second position, the compressed fluid discharged through the discharge port is further exhausted through the barrel; and a manually-actuated degassing tool disposed in the air gun for manually overcoming the biasing force to move the stopper from the normal position to the actuated position, and for maintaining the stopper in the actuated position to degas the reservoir.

2. The pre-charged pneumatic airgun of claim 1, further comprising a housing disposed over at least a portion of the stopper, the housing having an aperture through which the degassing tool is received.

3. The pre-charged pneumatic airgun of claim 2, wherein the stopper is moved from the normal position to the discharge position along an axis of the stopper and wherein the aperture has an axis that is substantially coaxial with the axis of the stopper.

4. The pre-charged pneumatic airgun of claim 3, wherein the degassing tool comprises an elongate shaft receivable in the aperture and the elongate shaft is movable along the axis of the aperture, movement of the elongate shaft imparting a movement on the stopper to move the stopper from the normal position to the discharge position.

5. The pre-charged pneumatic airgun of claim 4, wherein the aperture is threaded and wherein the degassing tool comprises a threaded portion cooperating with the threaded aperture.

6. The pre-charged pneumatic airgun of claim 4, wherein the degassing tool directly contacts the stopper to actuate the stopper to the discharge position.

7. The pre-charged pneumatic airgun of claim 4, further comprising a hammer proximate the stopper and movable between a cocked position spaced from the stopper and a fired position contacting the stopper, wherein the elongate shaft contacts the hammer in the fired position to move the hammer and the stopper, actuating the stopper to the discharge position.

8. The pre-charged pneumatic airgun of claim 7, wherein when the degassing tool contacts the hammer in the cocked position, the degassing tool is prevented from moving the hammer.

9. The pre-charged pneumatic airgun of claim 8, further comprising a sear that maintains the hammer in the cocked position to prevent movement of the hammer by the degassing tool.

10. The pre-charged pneumatic airgun of claim 8, the degassing tool comprising an elongate shaft received in an aperture of a housing of the gun, the aperture being threaded and the elongate shaft comprising a threaded portion receivable in the threaded aperture, wherein the threaded portion is not received in the threaded aperture when the hammer is in the cocked position.

11. The pre-charged pneumatic airgun of claim 1, further comprising:

a hammer proximate the stopper movable between a cocked position spaced from the stopper and a fired position contacting the stopper, wherein the degassing tool is movable to contact the hammer to drive the hammer against the stopper and thereby move the stopper to, and retain the stopper in, the actuated position.

12. The pre-charged pneumatic airgun of claim 11, wherein the stopper and the hammer are aligned along an axis along which the stopper and hammer are translatable.

13. The air gun of claim 12, wherein the degassing tool is movable along the axis.

14. The pre-charged pneumatic airgun of claim 13, further comprising an aperture having an axis substantially co-planar with the axis along which the stopper and the hammer are aligned, the degassing tool being received in the aperture.

15. A method of degassing a pre-charged pneumatic airgun, comprising:

providing a pre-charged pneumatic airgun including a reservoir containing a compressed fluid and a discharge port disposed in the reservoir for discharging the compressed fluid from the discharge port; a stopper disposed in a normal position to seal the discharge port and movable to a discharge position to allow passage of the compressed fluid from the reservoir through the discharge port; a housing at least partially covering the stopper and the reservoir, the housing including an aperture;

inserting a degassing tool into the aperture;

manually actuating the degassing tool to move the stopper from the normal position to the discharge position; and retaining the stopper in the discharge position to exhaust substantially all of the contents of the reservoir.

16. The method of claim 15, wherein the aperture is threaded and the degassing tool comprises a mating thread, and wherein manual actuation of the degassing tool comprises threading the degassing tool into the threaded aperture.

17. The method of claim 16, wherein a distal end of the degassing tool contacts the stopper when the degassing tool is inserted into the aperture.

18. The method of claim 16, wherein the pre-charged pneumatic airgun further comprises a hammer for contacting the stopper to actuate the stopper during firing of the pre-charged pneumatic airgun, and wherein a distal end of the degassing tool contacts the hammer to advance the hammer against the stopper and thereby actuate the stopper to the discharge position.

19. A degassing tool for a pre-charged pneumatic airgun having a reservoir containing a fluid disposed therein, the fluid being exhausted through a discharge port that is normally occluded by a stopper when the stopper is moved from a normally closed position to a discharge position, the degassing tool comprising:

an elongate shaft having a first end and a second end insertable into a threaded aperture formed in a housing of the pre-charged pneumatic airgun such that the second end contacts a surface in the housing and the first end is disposed outside the housing;

a thread formed on at least a portion of the elongate shaft to cooperate with the threaded aperture; and a head formed on the first end of the elongate shaft for manipulation by a user to promote threading the elongate shaft in the aperture, wherein the manipulation of the head by the user to move the degassing tool further into the housing causes the degassing tool to move the surface contacted by the second end of the elongate shaft to move the stopper to the discharge position.

20. The degassing tool of claim 19, wherein the surface contacted by the second end of the elongate shaft is a surface of the stopper.

21. The degassing tool of claim 19, wherein the surface contacted by the second end of the elongate shaft is a surface of a hammer disposed intermediate the stopper and the degassing tool.

* * * * *